United States Patent [19]

Sobel

[11] 4,278,033

[45] Jul. 14, 1981

[54] TAMPER RESISTANT SAFE

[75] Inventor: Marvin Sobel, Lansdale, Pa.

[73] Assignee: Bona Fide Factory Products, Inc., Huntingdon Valley, Pa.

[21] Appl. No.: 18,987

[22] Filed: Mar. 9, 1979

[51] Int. Cl.[2] ..... E05G 1/026

[52] U.S. Cl. ..... 109/59 R; 109/66; 109/73

[58] Field of Search ..... 109/50, 59, 64, 66, 109/73, 77; 49/40, 465; 220/345, 346; 232/15, 16; 312/257 SM

[56] References Cited

U.S. PATENT DOCUMENTS

| | | | |
|---|---|---|---|
| 1,168,408 | 1/1916 | Marbach | 109/64 |
| 1,854,839 | 4/1932 | Hermann | 109/66 X |
| 2,532,083 | 11/1950 | Brenner | 220/345 X |
| 3,667,648 | 6/1972 | Koziol | 220/345 X |
| 3,842,761 | 10/1974 | Bloom | 109/59 |

*Primary Examiner*—David H. Corbin

*Attorney, Agent, or Firm*—Weiser, Stapler & Spivak

[57] ABSTRACT

The tamper resistant safe includes an enclosure body of rugged steel construction which is bent to define a top opening. The top opening is enlarged and includes part of one side and part of the top to provide easy access to the safe interior. The enclosure top and side portions immediately adjacent to the opening include reinforcing constructions which cooperate with a sliding cover in a manner to reinforce and protect all junctions to discourage unauthorized entry therethrough.

13 Claims, 7 Drawing Figures

TAMPER RESISTANT SAFE

BACKGROUND OF THE INVENTION

The invention relates generally to the field of safes, and more particularly, is directed to a small, lightweight, sturdy safe suitable for home or office use.

The need to protect property and to provide for safe storage of valuables has been and continues to be an activity of considerable importance to civilized segments of society in an endeavor to develop reasonable safety measures for items of value, such as money, jewels, commercial papers and the like. In view of the great interest in the subject matter, it will be appreciated that literally hundreds of prior art devices have been developed by workers in this field in an effort to design storage facilities of adequate safety for the required purpose. Such prior facilities have varied in size and complexity through an extremely wide range of design parameters, depending upon the end result desired. For example, the United States government has designed, developed and constructed an enormous storage vault at Fort Knox within which to store and protect the nation's gold storage supply. At the other end of the scale, a school child can find adequate safety and peace of mind by storing his coins within a small, inexpensive, locked facility, for example a common piggy bank.

Between these two extremes, of course, prior workers have developed numerous more or less extensive, expensive and complicated constructions, for example the builtin vaults with massive vault doors which are common in many banks. Wall safes and heavy steel floor safes are commonly employed in places of business, hotels and the like and numerous types of locked boxes and safes have been developed for home use. As is apparent from the foregoing, depending upon the value and the size of the items to be stored, more or less expensive and complicated safe and vault constructions can be provided by utilizing known techniques. Despite the myriad of prior safe constructions which have in the past been produced, the need remains for an inexpensive, sturdy, easily installed, safe or strong box which is readily adapted for permanent installation at the place of use.

SUMMARY OF THE INVENTION

The present invention relates generally to the field of protective safes, and more particularly, is directed to a tamper resistant safe of relatively modest cost and size and which can be readily adapted for permanent use within a home, office or a small commercial establishment.

The present invention contemplates the use of a tamper resistant safe or strong box that is relatively inexpensive in cost, which can be easily transported to the place of installation and which can be readily secured in place in a short period of time by utilizing standard hand tools and without requiring skilled or trained mechanics for installation purposes.

The safe of the present invention includes a hollow, generally rectangular enclosure or body which is fabricated of strong, tough, tamper resistant material of a type which can be bent, cut, welded or otherwise worked to a final desired configuration at reasonable cost. In a preferred embodiment, the safe body is fabricated of eleven U.S. gauge steel sheet which is cut, bent, welded and otherwise worked as necessary to provide a small, relatively inexpensive, extremely tough, tamper resistant safe body. The steel sheet is cut, bent and otherwise worked with conventional metal working machinery as necessary to provide a body of generally rectangular cross sectional configuration including an enlarged top opening for access purposes. Preferably, the top opening is defined both by a portion of the enclosure top and by a portion of one of the enclosure side walls immediately adjacent to the top whereby an enlarged opening to provide easy access within the container is provided.

The enclosure or body is formed and designed about the opening in such a manner to provide grooves, flanges or other reinforcing constructions which, when taken in cooperation with the closure cover, provide reinforcement at every junction between the cover and the container to thereby discourage tampering.

A top cover or closure, which is generally L-shaped in cross sectional configuration, preferably is fabricated of a strong, decorative material such as stainless steel and, in cooperation with the grooves and flanges of the container, includes bent lips to provide a secure closure for the safe.

In the preferred embodiment, the top is L-shaped in configuration and includes a sliding leg and a locking leg in right angle orientation for safe closure and locking purposes. The locking leg slides horizontally within a pair of opposing tracks or grooves defined between the container top flanges and track strips and includes a locking leading edge or tongue to discourage prying between the leading edge of the sliding leg and the rear marginal edge which defines the container opening. One or more key or other operated locks are mounted within the locking leg in position to secure the cover to a permanent construction component of the container when it is desired to lock the device.

By utilizing modern tooling processes and assembly line techniques, the elements comprising the novel tamper resistant safe can be rather inexpensively manufactured and assembled to thereby provide an extremely strong, workable, lightweight, tamper resistant safe at a modest cost.

It is therefore an object of this present invention to provide an improved tamper resistant safe of the type set forth.

It is another object of the present invention to provide a novel tamper resistant safe that can be readily affixed to existing building construction members.

It is another object of the present invention to provide a novel tamper resistant safe that incorporates a heavy gauge steel body which is bent to the desired configuration to define a top opening and an enclosure cover that is a sliding fit within the body to lockably close the opening.

It is another object of the present invention to provide a novel tamper resistant safe incorporating a heavy steel body defining a generally rectangular interior compartment, the body terminating upwardly to define an enlarged access opening and a strong, lockable cover of generally L-shaped configuration which is a sliding fit within the body to securely close off access to the safe interior.

It is another object of the present invention to provide a novel tamper resistant safe that is rugged in construction, inexpensive in manufacture and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENTS OF THE INVENTION

Figure 1:
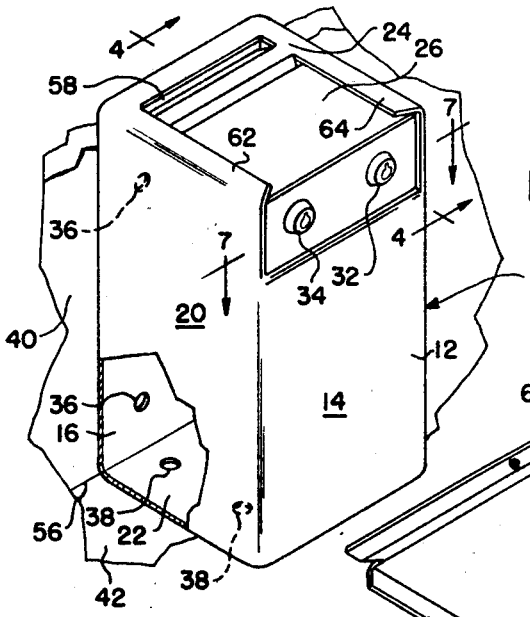
FIG. 1 is a perspective view of the tamper resistant safe of the present invention installed in the corner of a room.

Although specific terms are used in the following description for the sake of clarity, these terms are intended to refer only to the particular structure of the invention selected for illustration in the drawings, and are not intended to define or limit the scope of the invention.

Referring now to the drawings, the tamper resistant safe 10 of the present invention is illustrated in FIG. 1 installed in a room, for example adjacent the corner formed by the room wall 40 and the room floor 42. The safe 10 comprises generally an enclosure or container 12 formed with a front wall 14, a rear wall 16, a right side wall 18, a left side wall 20, a bottom 22 and a top 24 which components are formed to define an interior space 44 therewithin for valuable storage purposes. The top of the front wall 14 and the enclosure top wall 24 are cut or otherwise treated to define a top opening 46 to facilitate the placement of valuables into the safe interior 44 and the easy extraction of the valuables from the safe interior when so desired. By forming the top opening in both the top wall 24 and front wall 14, an opening of greater size can be conveniently provided to improve access.

Figure 3:
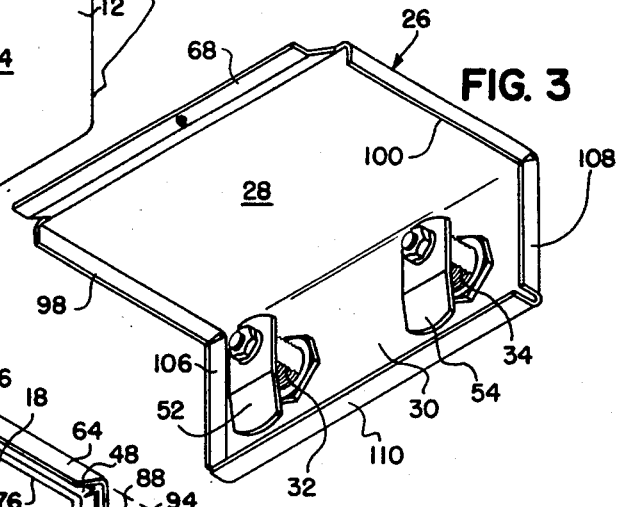
FIG. 3 is an enlarged, rear perspective view of the cover.
Figure 2:
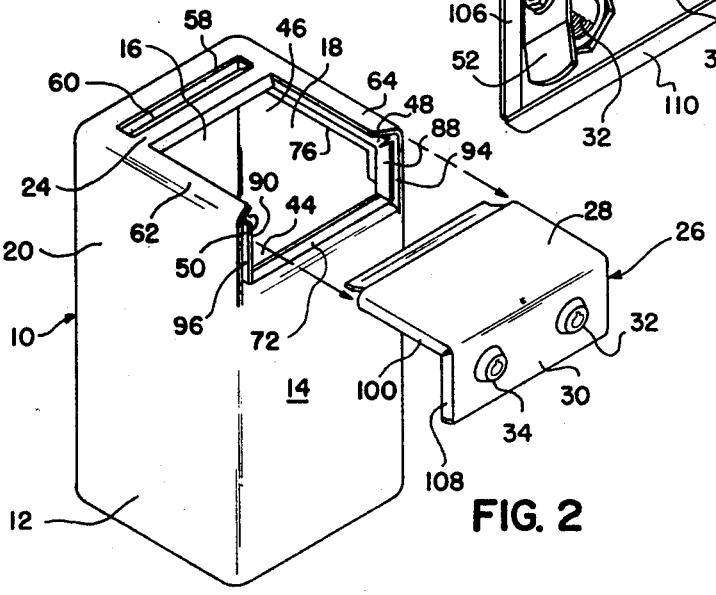
FIG. 2 is a perspective view similar to FIG. 1 showing a cover in exploded relationship.

A top cover 26 is a sliding fit within a pair of horizontally spaced upper tracks 48, 50 which are provided immediately below flanges 62, 64 of the top 24 for safe closure purposes. As best seen in FIGS. 2 and 3, the cover 26 is generally L-shaped in configuration and comprises a sliding leg 28 which is integral with and oriented at ninety degrees from the locking leg 30. The cover sliding leg 28 is configured to selectively close the portion of the top opening 46 defined by the container construction top 24. The cover locking leg 30 is configured to selectively close that portion of the top opening 46 defined at the top of the container front wall 14 when it is desired to lock the safe to protect any valuables placed within the safe interior 44.

One or more locks 32, 34 may be conventionally mounted in the locking leg 30 in usual manner to extend interiorly sufficiently to allow the locking projections 52, 54 rotatively to engage the interior flange 72 of the enclosure 12 when it is desired to lock the safe.

It is contemplated that the safe 10 will be fabricated of generally modest dimensions so that the device will be light enough to be readily moved to any desired location for permanent installation. For example, when it is desired to utilize the safe 10 within a structure, such as a room of a house, an office or a commercial establishment, the safe will first be placed in the desired permanent location, for example at the corner 56 of the room with the container bottom 22 adjacent to the room floor 42 and container back or rear wall 16 adjacent the room side wall 40. The safe can then be permanently secured in position by employing suitable fasteners through the bottom wall mounting openings 38 or the rear wall mounting openings 36 or any desired combination thereof. When the room floor construction 42 is of concrete, it will be necessary first to provide suitable openings in the concrete in alignment with the bottom mounting openings 38. Then conventional expansion shields or similar devices can be employed to securely affix the safe 10 to the floor 42.

In cases where the floor 42 or the wall 40 is fabricated of the wooden construction members, then sturdy threaded members such as lag screws or other fastening devices can be employed through the mounting openings 36 or 38 or combination thereof as may be required by the individual installation circumstances. In plaster constructions, suitable expansion type bolts (not shown) should be employed. It is noteworthy that the fastening members (not illustrated) utilized through the mounting openings 36, 38 will be driven into the wall 40 or floor 42 construction from within the interior space 44 defined within the safe enclosure or container 12. Accordingly, after the safe 10 has been secured in the desired position, and the cover 26 has been locked in position by utilizing the locks 32, 34 (FIG. 1), then a would-be thief would be unable to remove the fasteners (not illustrated) inasmuch as the heads of such fasteners will be fully protected within the locked enclosure and will not be subject to access.

As best seen in FIGS. 1 and 2, in a preferred embodiment, the container top 24 can be punched, bent or otherwise treated to define an elongated slot 58 with a depending protective tongue 60 to thereby provide an opening for the insertion of planar members, such as money, securities, etc. (not illustrated) into the safe interior 44 without the need to remove the cover 26. The top construction also includes a second depending tongue 66 for cover interlock as hereinafter more fully set forth.

Figure 4:
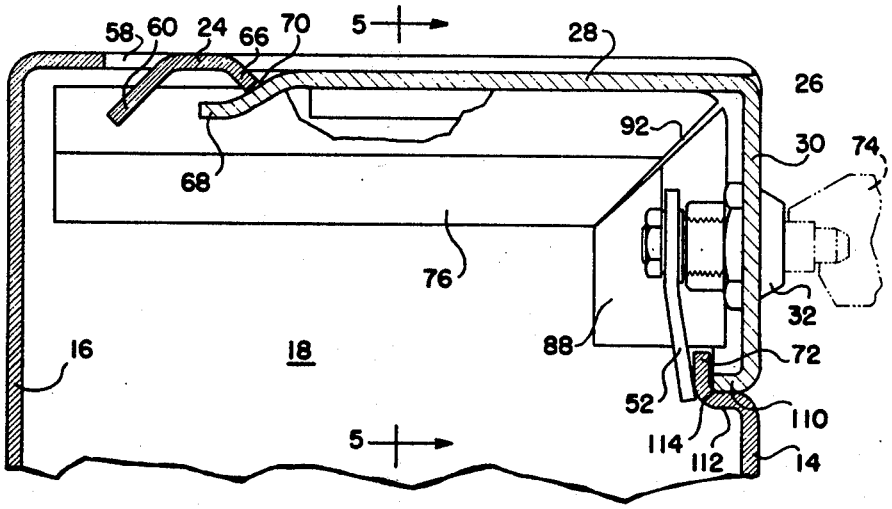
FIG. 4 is an enlarged, partial, cross-sectional view taken along line 4—4 of FIG. 1, looking in the direction of the arrows.

Referring now to FIGS. 4, 5, 6 and 7, the additional protective construction features about the safe closure will now be described. The container top 24 is bent to provide a pair of spaced, parallel flanges 62, 64 which act to retain the cover 26 in a sliding fit and further serve to define the top marginal extent of the top opening 46. The left and right top flanges 62, 64 terminate rearwardly at the depending tongue 66, which tongue interacts with the depending leading edge 68 of the cover sliding leg 28 to prevent tampering. As best seen in FIG. 4, the cover leading edge 68 projects downwardly and under the depending second tongue 66 of the container top 24 to form a first tool resistant interlock 70 when the cover 26 is fully seated on the enclosure 12 in the closed and locked position.

Still referring to FIG. 4, it will be seen that the container front wall 14 terminates upwardly in an inwardly bent flange 72, which flange defines the lower extent of the top opening 46. By extending the top opening 46 downwardly into the front wall 14, access to the container interior 44 is enlarged to facilitate insertion of of valuables into or removal of valuables from the interior of the safe 10. The bent front flange 72 additionally serves as a strike plate or keeper upon which the locking projections 52, 54 can be turned to bear thereagainst in order to prevent unwanted removal of the cover 26 when a key 74 is inserted into a lock 32 or 34 and turned to lock the device.

To form the pair of upper tracks 48, 50 to receive the sliding leg 28 of the cover 26 in sliding engagement therein, a pair of spaced, bent, steel strips 76, 78 are spot welded or otherwise securely affixed respectively to a container side 18, 20 near the respective tops thereof. The tops of the strips 76, 78 terminate below the bottoms of the flanges 62, 64 to define the upper tracks 48, 50 in cooperation with the top flanges 62, 64. Each of the strips 76, 78 is medially horizontally bent to inwardly space the respective upper track sections 80, 82 from the adjacent container side walls 18, 20 sufficiently to receive in sliding engagement the depending portions or lips 98, 100 of the sliding leg 28 therewithin when the cover is attached to the container. The respective base or lower track sections 84, 86 of the track strips 76, 78 respectively permanently affix directly to the interior sides of the container side walls 18, 20 in permanent, known manner such as by spot welding.

The front strips 88, 90 are affixed respectively to the container side walls 18, 20 forwardly of the track strips 76, 78 and may be arranged at right angles thereto through respective miter joints 92. The front strips 88, 90 are suitably medially bent to space their respective forward portions inwardly from the right and left side walls 18, 20 to form forwardly open recesses 94, 96 with the right and left side walls 18, 20. The recesses 94, 96 receive therein the side lip portions 106, 108 of the cover locking leg 30 when the cover 26 is fully seated on the enclosure 12 in the locked position.

Figure 5:
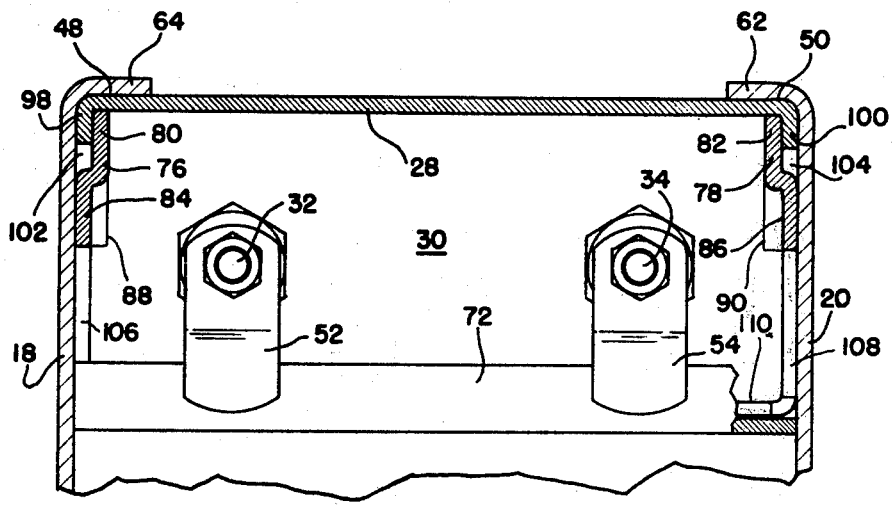
FIG. 5 is a cross-sectional view taken along line 5—5 of FIG. 4, looking in the direction of the arrows.
Figure 6:
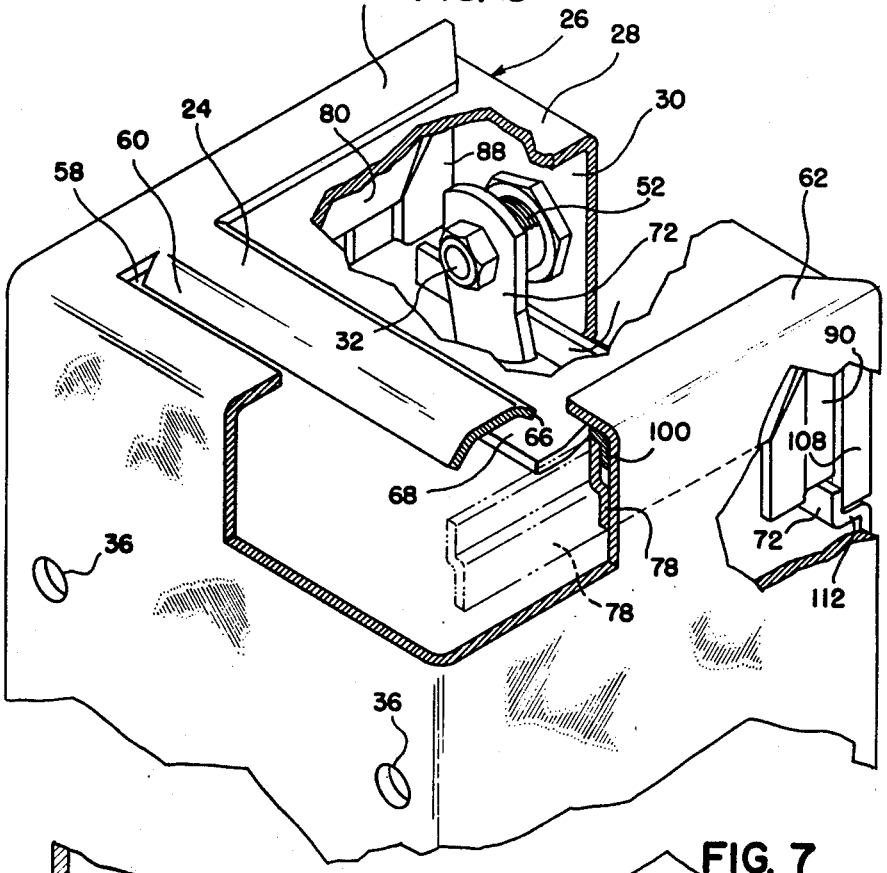
FIG. 6 is an enlarged, partial, perspective view of the container top and cover construction, partially broken away to expose details of interior construction features.

Referring now to FIG. 3, it will be observed that the transverse marginal edges of the cover sliding leg 28 are inwardly or downwardly bent to provide a pair of spaced, depending lips 98, 100. As illustrated in FIG. 5, the sliding leg lips 98, 100 fit within and slide within the recesses 102, 104 formed by spacing the respective upper track sections 80, 82 from the container side walls 18, 20. Thus it is seen that a complete, interlocked, strong, sliding, top engagement is formed between the sliding leg 28 of the cover 26 and the top 24 of the enclosure or container 12. The spaced edge portions of the sliding leg 28 insert within and slide within the respective right and left upper tracks 48, 50. Simultaneously, the depending lips 98, 100 insert within and slide within the recesses 102, 104 defined between the track strips 76, 78 and the container side walls 18, 20.

Thus it is seen that the container top construction overfits and shields the transverse marginal edges and the rearward edge of the sliding leg 28 of the cover 26 at all locations wherein a would-be thief might attempt to insert a tool in an effort to pry the cover 26 loose from the enclosure 12. More specifically, the leading edge 68 of the sliding leg 26 is fully protected beneath the top depending tongue 66 at the first interlock 70. The right side of the cover 26 is fully protected by the positioning and strength of the right top flange 64. Similarly, the left marginal extent of the sliding leg 28 is fully protected by the positioning and strength of the top left flange 62 which overfits and acts to prevent unauthorized entry. The right and left track strips 76, 78 define a sliding arrangement with the container top and sides to facilitate sliding engagement of the sliding leg 28 of the cover 26 therewithin in a manner to prevent tampering.

Figure 7:
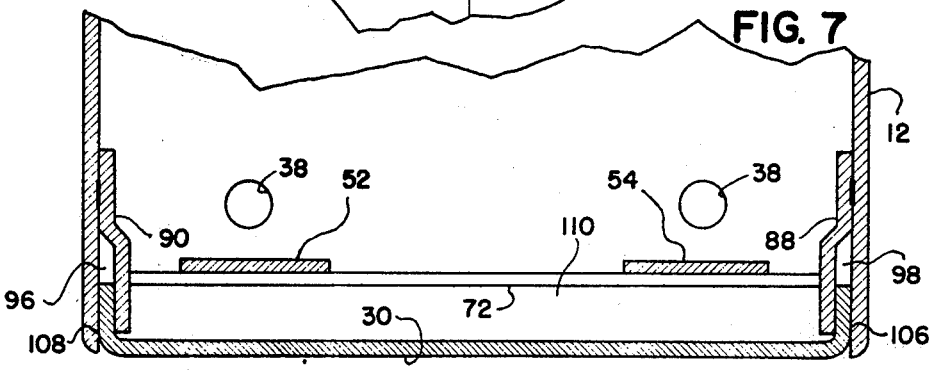
FIG. 7 is an enlarged, partial, cross-sectional view taken along line 7—7 of FIG. 1, looking in the direction of the arrows.

As illustrated best in FIGS. 3 and 7, the side marginal edges of the cover locking leg 30 are inwardly bent at right angles to form the respective rearwardly facing side lips 106, 108. The side lips 106, 108 slide respectively into the forwardly open recesses 94, 96 defined by the front strips 88, 90 to provide completely protected, enclosed, side closures when the cover 26 is fully seated and locked to cover the top opening 46.

The bottom edge of the locking leg 30 is similarly inwardly bent at ninety degrees to form a strengthening and tamper resisting flange 110 to further prevent unauthorized entry when the cover 26 is locked in position on the enclosure 12. As illustrated in FIG. 4, the bottom strengthening flange 110 stops against the front flange 72 which had been bent into the front wall 14. Preferably, the length of the offset 112 between the front wall 14 and the front flange 72 equals approximately the length of the cover strengthening flange 110 so that the strengthening flange 110 abuts tightly against the front flange 72 to form the second interlock 112 in a manner to prevent tampering or unauthorized entry at the bottom of the cover 26.

Although the invention has been described with a certain degree of particularity, it is understood that the present disclosure has been made only by way of example and that numerous changes in the details of construction and the combination and arrangement of parts may be resorted to without departing from the scope of the invention.

What is claimed is:

1. In a tamper resistant safe of the type comprising an enclosure having a bottom, sides, a front wall and a rear wall rising from the bottom and terminating upwardly in a planar top, an opening communicating with the interior of the enclosure and a lockable member movable between an open position and a locked position to selectively close the opening, the improvement comprising:

the said opening being defined by a part of the enclosure top and by a part of the enclosure front wall, a right flange formed in the top and defining the right extent of the opening, the right flange extending in length the entire depth of the opening, the right flange being in planar alignment with the top, a left flange formed in the top and defining the left extent of the opening, the left flange extending in length the entire depth of the opening, the left flange being in planar alignment with the top, and a front flange formed in the front wall and defining the bottom extent of the opening;

the lockable member being an L-shaped cover in sliding engagement with a part of the enclosure, the cover comprising a sliding leg which slidingly closes that part of the opening defined by the enclosure top, the sliding leg being bent downwardly at its transverse, marginal edges to provide a pair of spaced, depending lips, each lip being positioned respectively below one of said right and left flanges when the lockable member is in its said locked position, and a locking leg positioned at substantially ninety degrees to the sliding leg and being adapted to close that part of the opening defined by the enclosure front wall; and a lock mounted in the locking leg and adapted to secure the cover to the enclosure when the cover is moved to its said locked position.

2. The tamper resistant safe of claim 1 and a permanently open slot defined in the top rearwardly of the opening, the slot being adapted to admit planar materials into the enclosure without removal of the lockable member, the slot being defined in the top by a first protective tongue, the tongue being bent away from the plane of the top.

3. The tamper resistant safe of claim 2 wherein the cover sliding leg is adapted not to obstruct the slot when the lockable member is in either its open position or its locked position, the tongue being bent downwardly from the plane of the top.

4. The tamper resistant safe of claim 1 wherein the cover sliding leg includes a planar body which lies in a plane beneath the plane of the enclosure top and wherein the said spaced lips depend downwardly from the plane of the sliding leg body.

5. The tamper resistant safe of claim 4 wherein the top terminates at the opening in a second tongue the tongue being bent downwardly from the plane of the top, the sliding leg terminating rearwardly in a depending leading edge, the leading edge depending downwardly from the plane of the sliding leg body, the said tongue interacting with the leading edge of the sliding leg to provide a first interlock to discourage tampering when the cover is moved to its said locked position.

6. The tamper resistant safe of claim 5 wherein the depending leading edge of the sliding leg underlies the second tongue when the cover is in its locked position to form the first interlock.

7. The tamper resistant safe of claim 4 and a track strip affixed interiorly to an enclosure side wall below the right flange, the track strip and the flange defining an upper track therebetween and wherein one of the said lips of the cover sliding leg is adapted to slide within the upper track as the cover is moved between its said open and locked positions.

8. The tamper resistant safe of claim 7 wherein the track strip is bent to provide a recess between the track strip and the enclosure side and wherein the lip is parallel to and spaced inwardly from the enclosure side wall.

9. The tamper resistant safe of claim 4 and a front strip affixed to an enclosure side wall near the front wall, the front strip being bent to provide a forwardly open recess, the forwardly open recess being defined on one side by part of the front strip and on its other side by a part of the enclosure side wall.

10. The tamper resistant safe of claim 9 wherein a marginal edge portion of the cover locking leg is bent to define a rearwardly facing side lip, the side lip being adapted to fit within the forwardly open recess wherein the side lip is protected by the front strip and the part of the enclosure sidewall against tampering.

11. The tamper resistant safe of claim 6 wherein the part of the enclosure front wall defining the said opening is inwardly bent to define a horizontal offset and a front flange.

12. The tamper resistant safe of claim 11 wherein the bottom of the cover locking leg is inwardly bent to define a bottom flange, the said bottom flange overlying the horizontal offset when the cover is in its said locked position to prevent tampering at the bottom of the opening.

13. The tamper resistant safe of claim 12 wherein the cover bottom flange abuts and stops against the enclosure front flange when the cover is in its said locked position to provide a second interlock between the cover and the enclosure to discourage tampering.

* * * * *